US010935277B2

(12) United States Patent
Wang

(10) Patent No.: US 10,935,277 B2
(45) Date of Patent: Mar. 2, 2021

(54) TELESCOPING CURTAIN FOR WINDOW-TYPE AIR CONDITIONER

(71) Applicant: Zhen Wang, Hubei (CN)

(72) Inventor: Zhen Wang, Hubei (CN)

(73) Assignee: Zhen Wang, Zaoyang (CN)

( * ) Notice: Subject to any disclaimer, the term of this patent is extended or adjusted under 35 U.S.C. 154(b) by 147 days.

(21) Appl. No.: 16/038,170

(22) Filed: Jul. 17, 2018

(65) Prior Publication Data

US 2019/0024939 A1 Jan. 24, 2019

(30) Foreign Application Priority Data

Jul. 24, 2017 (CN) ..... 201710606812.4

(51) Int. Cl.
*F24F 1/04* (2011.01)
*F24F 13/20* (2006.01)
*F24F 1/027* (2019.01)

(52) U.S. Cl.
CPC ..... *F24F 13/20* (2013.01); *F24F 1/027* (2013.01); *F24F 1/04* (2013.01)

(58) Field of Classification Search
CPC .... F24F 13/20; F24F 1/027; F24F 1/04; F24F 1/0073; F24F 1/035; F24F 2003/008; F24F 13/085; F24F 13/28; F24F 3/1603; B01D 29/70; B01D 29/705
USPC ..... 454/203; 160/45, 130, 84.04, 84.07, 160/84.06, 372, 373, 377, 379, DIG. 8
See application file for complete search history.

(56) References Cited

U.S. PATENT DOCUMENTS 3,111,076 A * 11/1963 Martin, Jr. ..... F24F 1/04 454/203
3,911,803 A * 10/1975 Kong ..... E06B 7/03 454/203
5,295,903 A * 3/1994 Bolton ..... F24F 1/027 454/201
5,365,992 A * 11/1994 Swain ..... F24F 13/32 160/84.01

* cited by examiner

*Primary Examiner* — Grant Moubry
*Assistant Examiner* — Ryan L Faulkner

(57) ABSTRACT

The utility model discloses a telescoping curtain for a window-type air conditioner, comprised of a plurality of continuously arrayed telescoping units; frameworks are respectively arranged on two sides of each one of the telescoping units, and four rotating arms are disposed between every two adjacent frameworks; each one of the frameworks is provided with a first rotating arm and a second rotating arm toward one side, and a third rotating arm and a fourth rotating arm toward the other side; the first rotating arms is connected with the third rotating arm of the next framework, and the second rotating arms is connected with the fourth rotating arm of the next framework. The telescoping unit is internally provided with a plurality of partitions to form a dual-layer or multi-layer heat-insulating hollow structure. The utility model integrates the structures and components for conducting support, heat insulation, and connection functions well.

10 Claims, 5 Drawing Sheets

TELESCOPING CURTAIN FOR WINDOW-TYPE AIR CONDITIONER

BACKGROUND OF THE INVENTION

The utility model relates to an air conditioner accessory, specifically to a telescoping curtain for a window-type air conditioner.

For an existing telescoping curtain applied to a window-type air conditioner, the telescoping curtain 1 and a frame 2 are assembled to form a telescoping component (refer to FIG. 1), where the telescoping curtain 1 is capable of being pulled and shortened when telescoping in the frame 2, and the telescoping component is equipped on the machine casing (refer to FIG. 2). The telescoping component is also required to be used in combination with foam 3. The width of the telescoping component varies with the space of an actual installation position. Then, foam 3 is required to be cut according to the actual width, and the cut foam is placed in the designed guide slot 4 of the telescoping curtain 1 or is directly adhered to the frame 2 of the telescoping curtain (refer to FIG. 3) to form a telescoping curtain component so as to achieve the effect of insulating heat and insulating air ventilation inside and outside, where the foam plays the role of heat insulation.

When the telescoping curtain 1 is installed during the after-sales service, users need to install the foam 3 or adhere the foam to the telescoping curtain accessory on a window machine. During practical use, the existing telescoping curtain has the following disadvantages: seams between the telescoping curtain 1 and the frame 2 result in poor heat insulation effect; during actual installation of the foam 3, it is difficult to install the foam in place such that the telescoping curtain 1 achieves a poor heat insulation effect; it is complicated to install the telescoping curtain component which works as a partition between the indoor and outdoor environment, and it is complicated to install the foam 3 which performs heat insulation; the foam 3 tends to damage and deform, thus shortening its service life; and the foam 3 is required to be cut relative to actual situations, so the operation is inconvenient.

Therefore, a novel telescoping curtain is required to overcome the defects in the prior art.

BRIEF SUMMARY OF THE INVENTION

The objective of the utility model is to provide a telescoping curtain for a window-type air conditioner, which is different from the existing telescoping curtains made of a single-layer partition material, and is capable of solving various problems such as the use of foam to achieve the heat insulation effect, complicated operation, and large difficulties in actual operation.

In order to achieve the above objective, the utility model provides a telescoping curtain for a window-type air conditioner, where the telescoping curtain is comprised of a plurality of continuously arrayed telescoping units; the telescoping units are hollow and long columns; a framework is disposed on each one of the two sides of each one of the telescoping units, and four rotating arms are disposed between two adjacent frameworks; the frameworks are long rectangular sheets disposed in a longitudinal way, and all frameworks in the telescoping curtain are parallel to one another and respectively vertical to the plane where the telescoping curtain exists, which means that the rectangular planes of the framework sheets are vertical to the plane formed through unfolding the telescoping curtain. From the two long rectangular edges, each one of the frameworks is respectively provided with a first rotating arm and a second rotating arm toward one side face of the framework, and a third rotating arm and a fourth rotating arm toward the other side face of the framework; the first rotating arm on each one of the frameworks is connected with the third rotating arm on the adjacent next framework, the second rotating arm is connected with the fourth rotating arm on the adjacent next framework, and the four rotating arms and the frameworks on two sides form a frame-form telescoping unit; and two adjacent telescoping units share the same framework there-between. Each one of the rotating arms is capable of rotating around a long edge of the connected framework sheet, and two connected rotating arms are also capable of performing relative rotation such that the rotating arms are flattened or bent, and that the frameworks get close or move away from each other, thus unfolding or folding the telescoping units. Each one of the rotating arms and the connected framework form a corner there-between, and two adjacent rotating arms also form a corner there-between. By pulling and pushing the two ends of the telescoping curtain, corners change in angle to telescope the telescoping units, thereby telescoping the whole telescoping curtain. When each one of the telescoping units is completely stretched, the cross sections of the two frameworks and four rotating arms thereof form a rectangle; and when each one of the telescoping units is completely compressed, the cross sections of the two frameworks and four rotating arms thereof form two triangles of which the apex angles are face to face and are overlapped. For folding of the hollow telescoping units, the rotating arms are designed to be folded toward the inner hollow space to save space. If allowed by the structural space, the rotating arms may also be folded outward.

In the telescoping curtain for the window-type air conditioner, a plurality of partitions are uniformly disposed in the hollow inner space of each one of the telescoping units to divide each one of the telescoping units into a plurality of layers; and the telescoping units are consistent in the number and positions of the partitions therein such that each one of the plurality of continuously arrayed telescoping units is internally formed with a uniformly layered two-layer or multi-layer heat-insulating hollow structure. The number of the partitions is preferably 1 such that the inner hollow structure of each one of the telescoping units is uniformly divided into two layers, namely an upper layer and a lower layer. All telescoping units may be internally provided with partitions, or a part of the telescoping units may be internally provided with partitions, which means that the partitions in the telescoping units may be connected or disconnected. The middle partitions are added to block heat radiation.

In the telescoping curtain for a window-type air conditioner, each one of the partitions is comprised of two partition rotating arms which are connected on the inner sides thereof, while the outer sides of the two partition rotating arms are respectively connected with the framework on the same side of each corresponding one of the telescoping units; each one of the partition rotating arms is long rectangular sheet disposed in a longitudinal way, with a long edge on one side connected with a long rectangular edge of each corresponding one of the framework sheets, and a long edge on the other side connected with a long edge of an adjacent rotating arm; each one of the partition rotating arms is capable of rotating around a long edge of the connected framework sheet, and two connected partition rotating arms are also capable of performing relative rotation, thereby driving the partitions to be folded or unfolded to telescope along with the telescoping units. Each one of the opposite frameworks on two sides of each one of the elementary telescoping units is provided with two partition rotating arms toward the interior of each one of the telescoping units, where the partition rotating arms are mutually connected and are capable of rotating; each one of the telescoping units may also be added with partition rotating arms to form partitions so as to sub-divide the layers of each one of the telescoping units, thus forming a multi-layer porous hollow structure which plays the role of blocking the heat radiation from the air and enhancing the heat insulation effect. The material thickness of each one of the partition rotating arms is usually small, within a range of 0.2-0.5 mm. One of the two partition rotating arms of each one of the partitions is consistent with the first rotating arm and the second rotating arm in the orientation, and the other is consistent with the third rotating arm and the fourth rotating arm in orientation.

In the telescoping curtain for a window-type air conditioner, each one of the rotating arms is long rectangular sheet disposed in a longitudinal way, with a long edge on one side connected with a long rectangular edge of each corresponding one of the framework sheets, and a long edge on the other side connected with a long edge of an adjacent rotating arm. The rectangular surfaces of the four rotating arms and the two partition layers of each one of the telescoping units are identical in shape and size, and the length of the long rectangular edge thereof is equal to the long rectangular edge of the framework sheet. The first rotating arms and the third rotating arms of a plurality of telescoping units are connected in turn, and the second rotating arms and the fourth rotating arms are connected in turn, forming the surface layers of two curtain faces of the front and back sides of the whole telescoping curtain. The frameworks of a plurality of continuously arrayed telescoping units play a support and connection role and form an inner hollow structure. Each one of the partitions divides the inner space of each corresponding one of the telescoping units into two layers, namely an inner layer and an outer layer, or further divides the inner space into multiple layers In the telescoping curtain for a window-type air conditioner, among the rotating arms, the first rotating arm and the third rotating arm on one framework are connected with the same long edge of the framework sheet and unfold toward the two sides of the framework sheet, and the second rotating arm and the fourth rotating arm are connected with the other long edge of the framework sheet and unfold toward the two sides of the framework sheet.

In the telescoping curtain for a window-type air conditioner, among the rotating arms, the distance C between two long rectangular edges of each one of the rotating arm sheets is approximately ½ of the distance H between two long edges of each one of the frameworks, which means that the length of the short rectangular edge of each one of the rotating arms, namely the width of each one of the rotating arms, is preferably approximately ½ of the framework width upon the application site of the telescoping curtain. The distance between the two long rectangular edges of each one of the framework sheets is 10-30 mm, which means that the length of the short rectangular edge of each one of the rotating arms or the width of each one of the rotating arms, namely the thickness of the hollow structure of each one of the telescoping units, is preferably approximately 10-30 mm.

In the telescoping curtain for a window-type air conditioner, the frameworks and the rotating arms are molded by integrated extrusion, which means that the whole telescoping curtain is primarily molded by an extrusion process, namely a blow molding process. The surfaces of the frameworks and rotating arms are sprayed or covered with a heat-insulating fire-retardant sunscreen layer, which means that the surfaces of the frameworks and rotating arms are sprayed or covered with a heat-insulating fire-retardant coating or material.

In the telescoping curtain for a window-type air conditioner, the framework at the outermost side of each one of the two ends of the telescoping curtain is provided with two inward rotating arms, and on the outer face of each one of the two ends of the telescoping curtain, the framework is provided with a connecting structure for installing and fixing the telescoping curtain on the casing of the window-type air conditioner. The connecting structure may be combined with a window and combined with an installed machine casing, reducing other auxiliary components. The connecting structure is preferably a long dual-head hook which is arranged along the middle line on the outer surface of the outermost framework of the telescoping curtain.

In the telescoping curtain for a window-type air conditioner, the telescoping curtain has a telescoping distance A in a range of 50-350 mm from the point where all the telescoping units are completely compressed to the point where all the telescoping units are completely unfolded. Namely, the hollow wrinkles of each one of the telescoping units of the telescoping curtain are capable of being folded, and when a plurality of hollow telescoping units are connected together, the telescoping curtain may stretch and shrink freely to realize change of size, where the size changes within a range of 50-350 mm.

In the telescoping curtain for a window-type air conditioner, fillers in the hollow space in the telescoping units are air or porous foam fillers. Namely, the hollow cavity of each one of the telescoping units is added with other porous or foam materials with a relatively smaller density by means of filling and foaming, for example, Pu foam, cotton, etc., to achieve a better heat insulation effect.

The telescoping curtain for a window-type air conditioner provided by the utility model has the following advantages:

1. By using the feature of the low heat conductivity coefficient of air (poor heat conductors of air have a heat conductivity coefficient $\lambda$ of 0.024 W/m·K at the barometric pressure and at the temperature of 0° C.; ABS plastic has a heat conductivity coefficient of 0.25 W/m·K; the heat conductivity coefficient of air is 1/10 that of plastic parts), the structure is designed as a hollow structure, and the hollow structured cavity mainly has air inside. Therefore, the heat preservation and insulation effect is achieved by using the feature that heat conductivity coefficient of air is very small, bad for heat conduction, and good for heat preservation.

2. The utility model is molded by integrated extrusion to integrate the original telescoping curtain components, such as the telescoping curtain body, foam and inserts for conducting the support, heat insulation and connection functions, into one component, thus greatly simplifying the structure.

3. The mature extrusion process makes processing easy, greatly enhances the component productivity, and reduces cost.

4. The integrated design reduces the assembly procedures, and greatly enhancing the production and assembly efficiency.

DETAILED DESCRIPTION OF THE INVENTION

Figure 1:
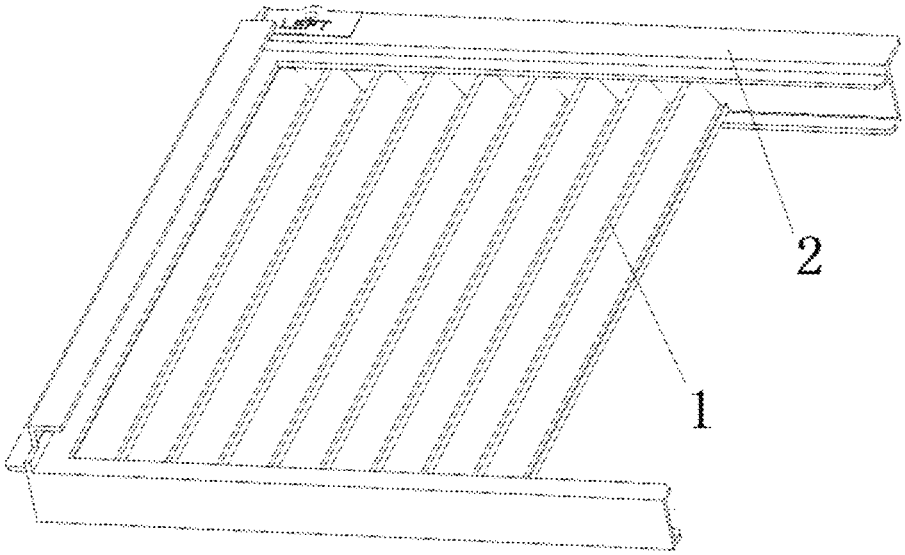
FIG.1 Prior Art
FIG. 1 is a schematic view of an existing telescoping curtain for a window-type air conditioner and a frame.
Figure 2:
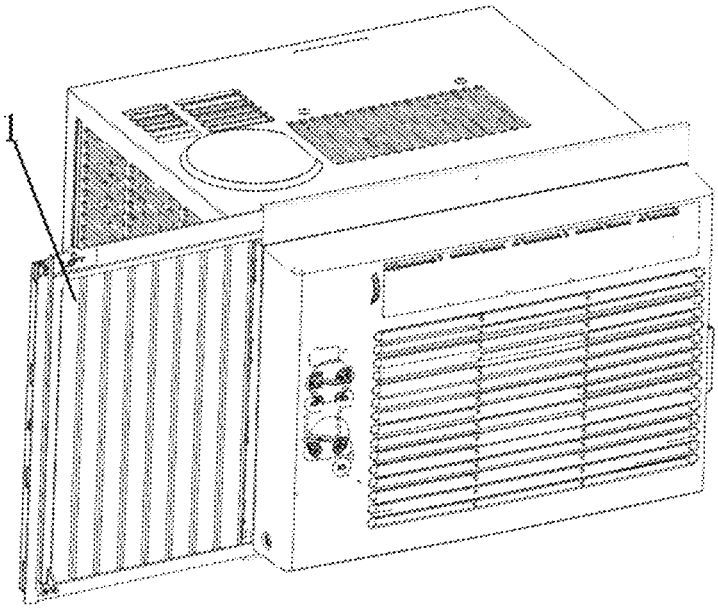
FIG. 2 Prior Art
FIG. 2 is an assembly view of an existing telescoping curtain for a window-type air conditioner.
Figure 3:
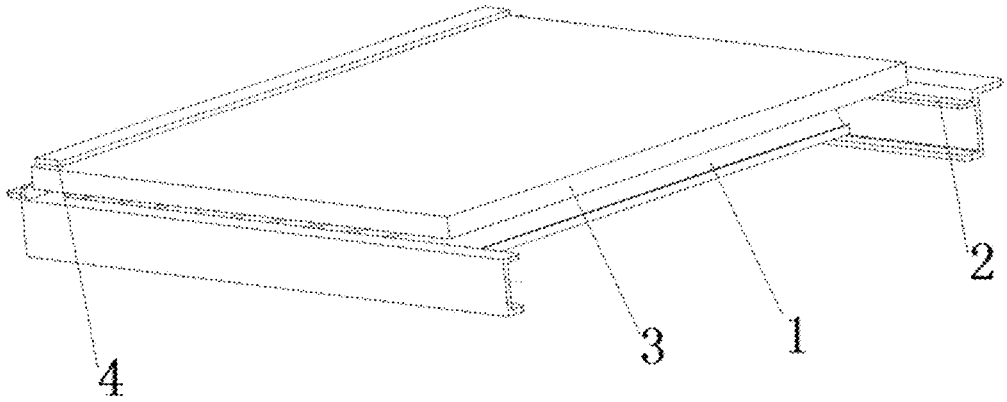
FIG. 3 Prior Art
FIG. 3 is a schematic view of assembling of an existing telescoping curtain for a window-type air conditioner and foam.
Figure 4:
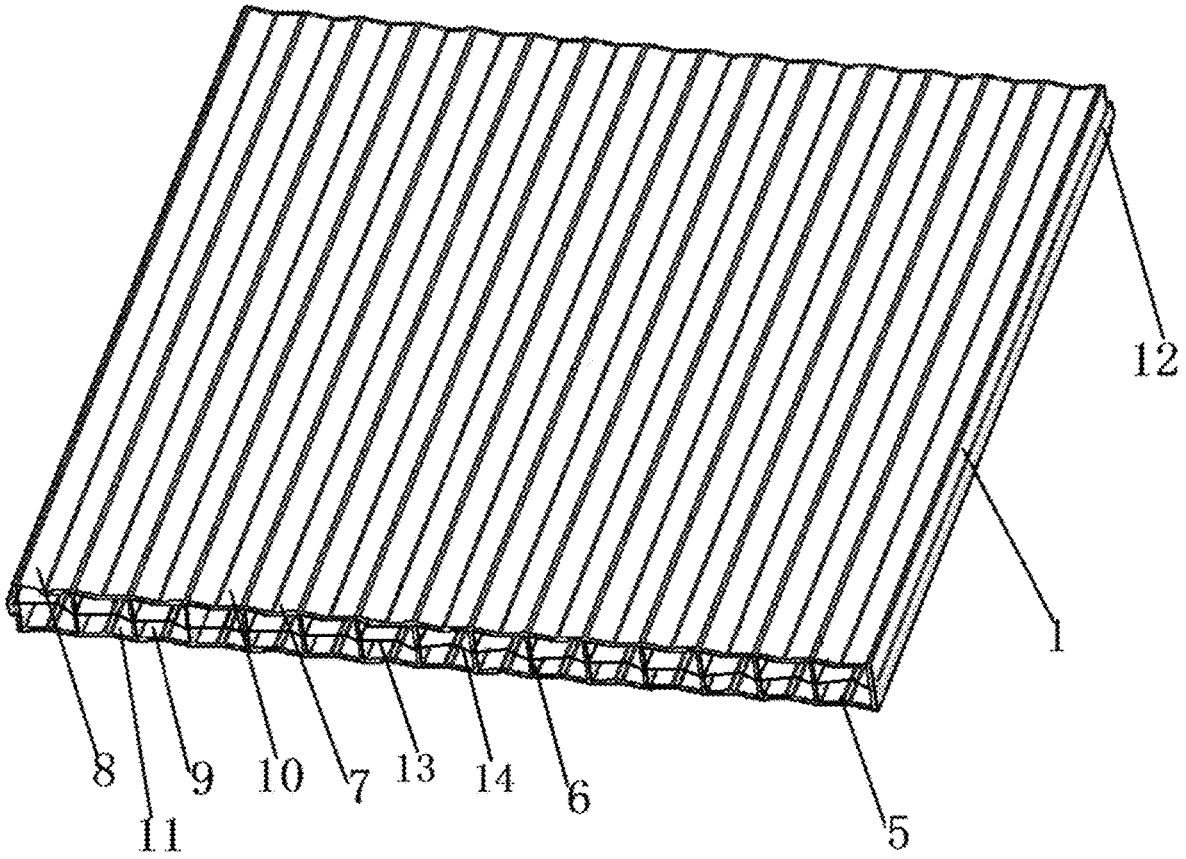
FIG. 4 is a three-dimensional view of a telescoping curtain for a window-type air conditioner of the utility model.
Figure 5:
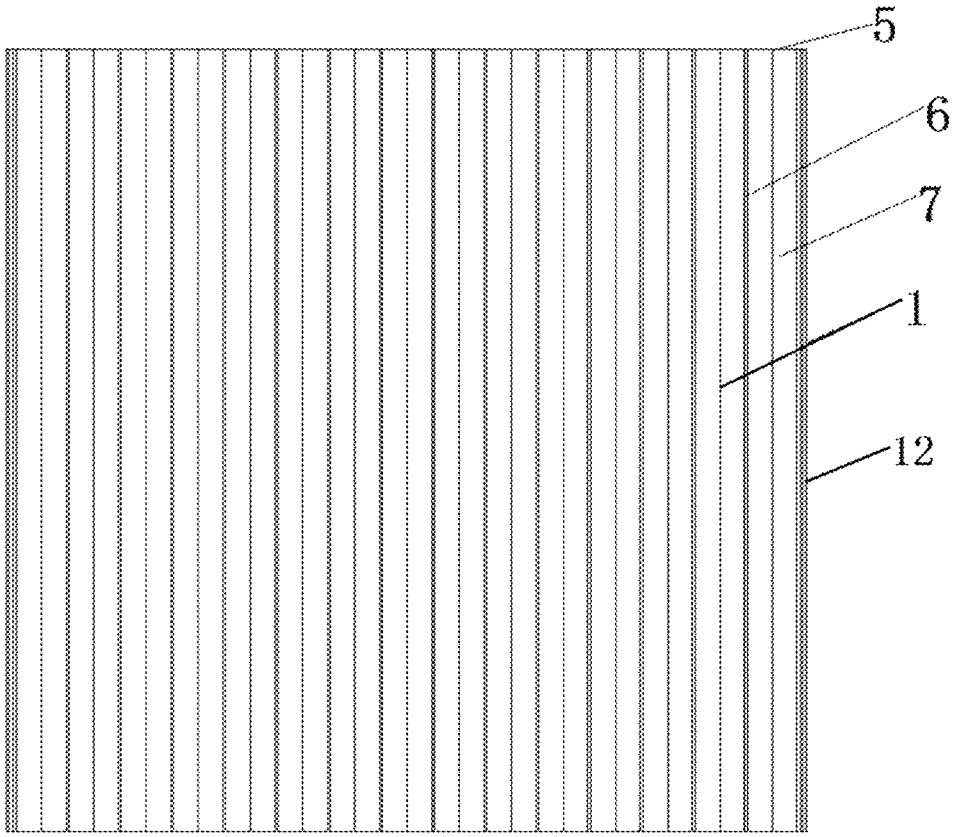
FIG. 5 is a front view of the telescoping curtain for a window-type air conditioner of the utility model.
Figure 6:
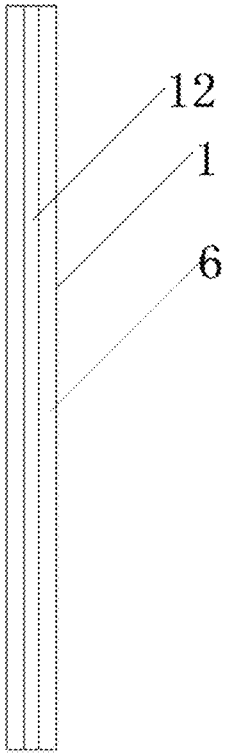
FIG. 6 is a lateral view of the telescoping curtain for a window-type air conditioner of the utility model.
Figure 7:
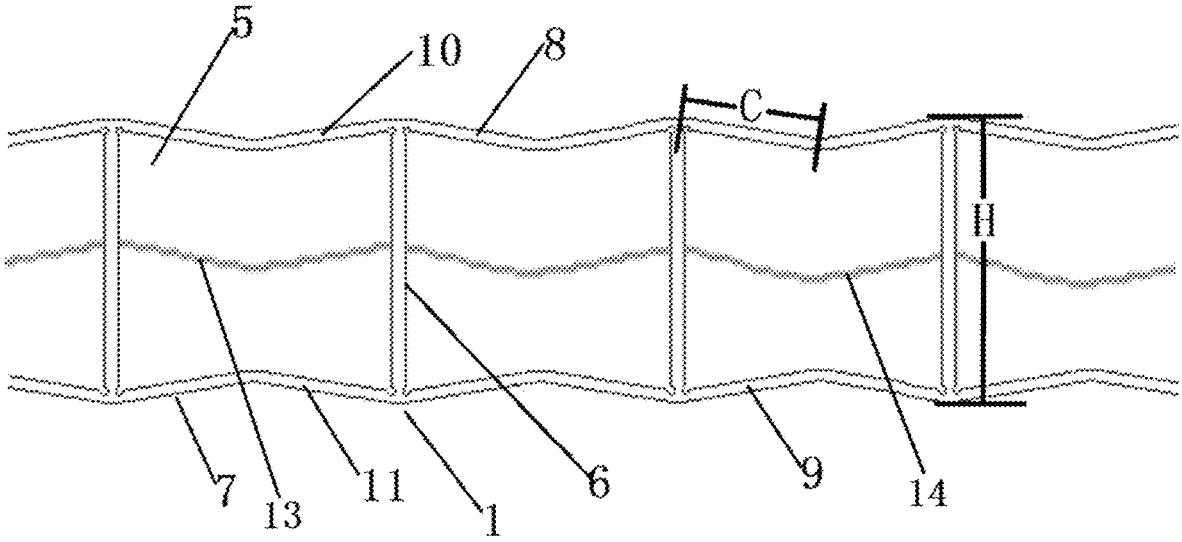
FIG. 7 is a structural view of the telescoping curtain for a window-type air conditioner of the utility model.

The specific implementation of the utility model is described in further detail in conjunction with the attached drawings.

As shown in FIG. 4-7, the utility model provides a telescoping curtain for a window-type air conditioner. The telescoping curtain 1 is comprised of a plurality of continuously arrayed telescoping units 5.

The telescoping units 5 are hollow and long columns; a framework 6 is disposed on each one of the two sides of each one of the telescoping units 5, and four rotating arms 7 are disposed between two adjacent frameworks 6.

The frameworks 6 are long rectangular sheets disposed in a longitudinal way, and all frameworks 6 in the telescoping curtain 1 are parallel to one another and respectively vertical to the plane where the telescoping curtain 1 exists, which means that the rectangular planes of the framework 6 sheets are vertical to the plane formed through unfolding the telescoping curtain 1. From the two long rectangular edges, each one of the frameworks 6 is respectively provided with a first rotating arm 8 and a second rotating arm 9 toward one side face of the framework 6, and a third rotating arm 10 and a fourth rotating arm 11 toward the other side face of the framework 6; the first rotating arm 8 on each one of the frameworks 6 is connected with the third rotating arm 10 on the adjacent next framework 6, while the second rotating arm 9 is connected with the fourth rotating arm 11 on the adjacent next framework 6, and the four rotating arms 7 and the frameworks 6 on two sides form a frame-form telescoping unit 5; and two adjacent telescoping units 5 share the same framework 6 there-between.

The hollow inner space of each one of the telescoping units 5 is uniformly provided with a plurality of partitions 13 to divide each one of the telescoping units 5 into a plurality of layers; and the telescoping units 5 are consistent in the number and position of the partitions 13 therein such that each one of the plurality of continuously arrayed telescoping units 5 is internally formed with a uniformly layered two-layer or multi-layer heat-insulating hollow structure. The number of the partitions 13 is preferably 1 such that the inner hollow structure of each one of the telescoping units 5 is uniformly divided into two layers, namely an upper layer and a lower layer.

Each one of the partitions 13 is comprised of two partition rotating arms 14 which are connected on the inner sides thereof, and the outer sides of the two partition rotating arms 14 are respectively connected with the framework 6 on the same side of each corresponding one of the telescoping units 5; each one of the partition rotating arms 14 is a long rectangular sheet disposed in a longitudinal way, with a long edge on one side connected with a long rectangular edge of each corresponding one of the framework 6 sheets, and a long edge on the other side connected with a long edge of an adjacent partition rotating arm 14; each one of the partition rotating arms 14 is capable of rotating around a long edge of the connected framework 6 sheet, and two connected partition rotating arms 14 are also capable of performing relative rotation, thereby driving the partitions 13 to be folded or unfolded to telescope along with the telescoping units 5. The material thickness of each one of the partition rotating arms 14 is usually small, within a range of 0.2-0.5 mm. One of the two partition rotating arms 14 of each one of the partitions 13 is consistent with the first rotating arm 8 and the second rotating arm 9 in the orientation, and the other is consistent with the third rotating arm 10 and the fourth rotating arm 11 in orientation.

Each one of the rotating arms 7 is along rectangular sheet disposed in a longitudinal way, with a long edge on one side connected with a long rectangular edge of each corresponding one of the framework 6 sheets, and a long edge on the other side connected with a long edge of an adjacent rotating arm 7. The rectangular surfaces of the four rotating arms 7 and the two partition layers of each one of the telescoping units 5 are identical in shape and size, and the length of the long rectangular edge thereof is equal to the long rectangular edge of the framework 6 sheet.

Among the rotating arms 7, the first rotating arm 8 and the third rotating arm 10 on one framework 6 are connected with the same long edge of the framework 6 sheet and unfold toward the two sides of the framework 6 sheet, and the second rotating arm 9 and the fourth rotating arm 11 are connected with the other long edge of the framework 6 sheet and unfold toward the two sides of the framework 6 sheet.

The distance C between the two long rectangular edges of each one of the rotating arm 7 sheets is approximately ½ of the distance H between two long edges of each one of the frameworks 6, which means that the length of the short rectangular edge of each one of the rotating arms 7, namely the width of each one of the rotating arms 7, is preferably approximately ½ of the width of the framework 6 upon the application site of the telescoping curtain 1. The distance between the two long rectangular edges of each one of the framework 6 sheets is 10-30 mm, which means that the length of the short rectangular edge of each one of the frameworks 6 or the width of each one of the frameworks 6, namely the thickness of the hollow structure of each one of the telescoping units 5, is preferably approximately 10-30 mm.

Each one of the rotating arms 7 is capable of rotating around a long edge of the connected framework 6 sheet, and two connected rotating arms 7 are also capable of performing relative rotation such that the rotating arms 7 are flattened or bent, and that the frameworks 6 get close or move away from each other, thus unfolding or folding the telescoping units 5. Each one of the rotating arms 7 and the connected framework 6 form a corner there-between, and two adjacent rotating arms 7 also form a corner there-between. By pulling and pushing the two ends of the telescoping curtain 1, corners change in angle to telescope the telescoping units 5, thereby telescoping the whole telescoping curtain 1. When each one of the telescoping units 5 is completely stretched, the cross sections of the two frameworks 6 and four rotating arms 7 thereof form a rectangle; and when each one of the telescoping units 5 is completely compressed, the cross sections of the two frameworks 6 and four rotating arms 7 thereof form two triangles of which the apex angles are face to face and are overlapped. For folding of the hollow telescoping units 5, the rotating arms 7 are designed to be folded toward the inner hollow space to save space. If allowed by the structural space, the rotating arms 7 may also be folded outward.

Figure 8:
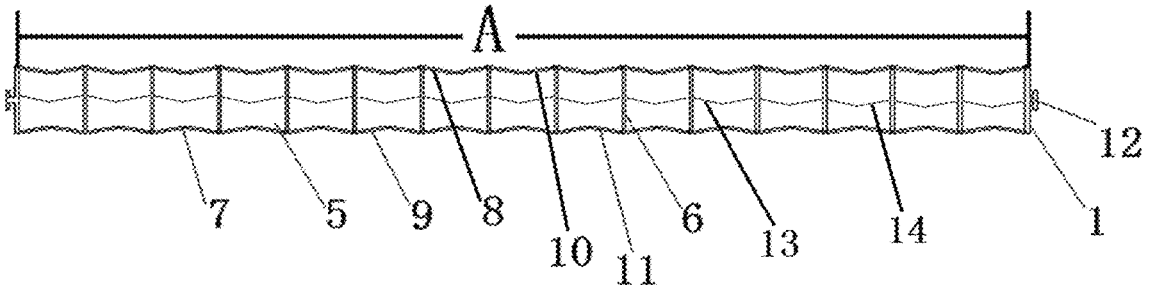
FIG. 8 is a top view of the unfolding telescoping curtain for a window-type air conditioner of the utility model.
Figure 9:
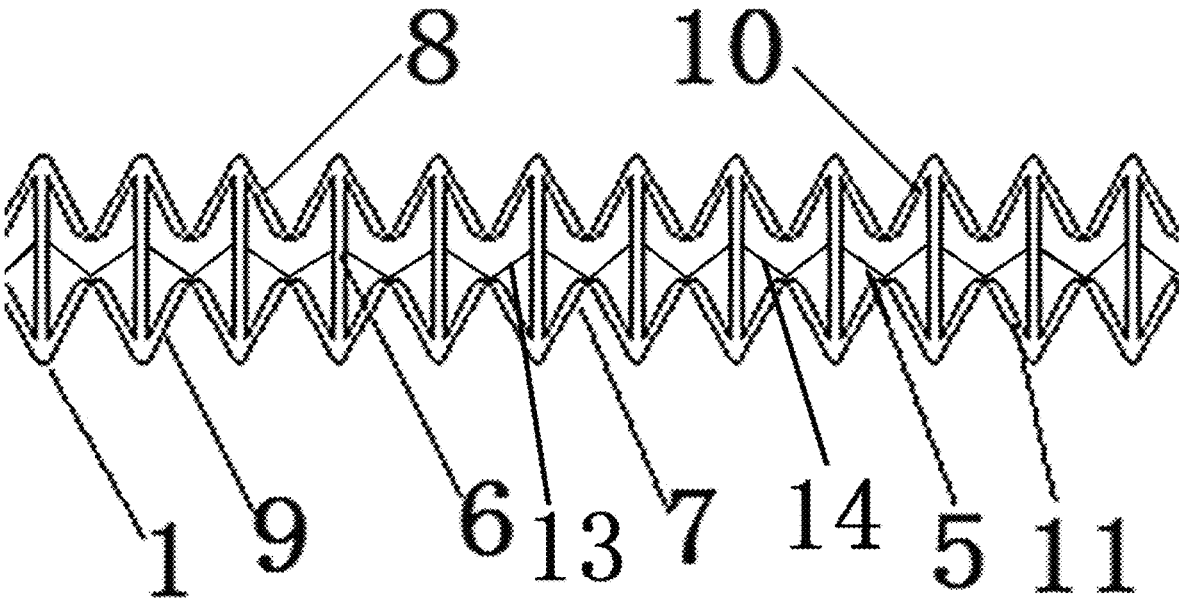
FIG. 9 is a schematic view of the folding of the telescoping curtain for a window-type air conditioner of the utility model.

The telescoping curtain 1 has a telescoping distance A in a range of 50-350 mm from the point where all the telescoping units 5 are completely compressed to the point where all the telescoping units 5 are completely unfolded. Namely, the hollow wrinkles of each one of the telescoping units 5 of the telescoping curtain 1 are capable of being folded, and when a plurality of hollow telescoping units 5 are connected together, the telescoping curtain 1 may stretch and shrink freely to realize a change of size, where the size changes preferably within a range of 50-350 mm. Refer to FIG. 8 and FIG. 9.

The framework 6 at the outermost side of each one of the two ends of the telescoping curtain 1 is provided with two inward rotating arms 7, and on the outer face of each one of the two ends of the telescoping curtain 1, the framework 6 is provided with a connecting structure 12 for installing and fixing the telescoping curtain 1 on the casing of a window-type air conditioner. The connecting structure may be combined with a window and combined with an installed machine casing, reducing other auxiliary components. The connecting structure 12 is preferably a long dual-head hook which is arranged along the middle line on the outer surface of the outermost framework 6 of the telescoping curtain.

The frameworks 6 and the rotating arms 7 all are preferably molded by integrated extrusion, which means that the whole telescoping curtain 1 is primarily molded by an extrusion process, namely a blow molding process. The surfaces of the frameworks 6 and rotating arms 7 are sprayed or covered with a heat-insulating fire-retardant sunscreen layer, which means that the surfaces of the frameworks 6 and rotating arms 7 are sprayed or covered with a heat-insulating fire-retardant coating or material.

Fillers in the hollow space in the telescoping units 5 are air or porous foam fillers. Namely, the hollow cavity of each one of the telescoping units 5 is added with other porous or foam materials with a reactively smaller density by means of filling and foam, for example, Pu foam, cotton, etc., to achieve a better heat insulation effect.

The telescoping curtain for the window-type air conditioner provided by the utility model is described in further detail in conjunction with the attached embodiment.

Embodiment 1

Provided is a telescoping curtain for the window-type air conditioner. The telescoping curtain 1 is formed by a plurality of connected hollow telescoping units 5; each one of the hollow telescoping units 5 is comprised of two frameworks 6 and four rotating arms 7, where the two frameworks 6 are designed to be opposite and be located on two sides of the hollow telescoping unit 5, the four rotating arms 7 are respectively disposed on the other two opposite sides of the hollow telescoping unit 5; and the four rotating arms 7 are respectively a first rotating arm 8, a second rotating arm 9, a third rotating 10 and a fourth rotating arm 11. Joints between the frames 6 and rotating arms 7 and joints between the rotating arms 7 of each one of the hollow telescoping units 5 are capable of being bent, which means that corners are capable of being bent. After the corners are bent, a folding effect is achieved; and when the corners are unfolded, a rectangular frame is formed. For folding of the hollow telescoping units 5, the rotating arms 7 are designed to be folded toward the inner hollow space to save space. If allowed by the structural space, the rotating arms 7 may also be folded outward. Each one of the hollow telescoping units 5 and the adjacent hollow telescoping share one framework 6.

In accordance with the application site of the telescoping structure, the recommended design heights H of the frameworks 6 of each one of the hollow telescoping units 5 are within the range of 10-30 mm, preferably 20 mm.

In accordance with the application site of the telescoping structure, the recommended design length C of each one of the hollow telescoping units 5 is approximately H/2.

Each hollow wrinkle is capable of being folded, and when a plurality of hollow telescoping units 5 are connected together, the telescoping curtain 1 may stretch and shrink freely to realize the change of size A, where the size A may change within a range of 50-350 mm, preferably 150 mm in this embodiment.

Each one of the telescoping units 5 is internally provided with partitions 13 such that a plurality of continuously arrayed telescoping units 5 form a uniformly-layered two-layer or multi-layer heat insulation hollow structure. The number of the partitions 13 is preferably 1 such that the inner hollow structure of each one of the telescoping units 5 is uniformly divided into two layers, namely an upper layer and a lower layer. Each one of the opposite frameworks 6 on two sides of each one of the elementary telescoping units 5 is provided with two partition rotating arms 14 toward the interior of each one of the telescoping units 5 where the partition rotating arms are mutually connected and are capable of rotating; each one of the telescoping units 5 may also be added with partition rotating arms 14 to form partitions 13 so as to sub-divide the layers of each one of the telescoping units 5, thus forming a multi-layer porous hollow structure which plays the role of blocking the heat radiation of air and enhancing the heat insulation effect.

The first rotating arms 8 and the third rotating arms 10 of a plurality of telescoping units 5 are connected in turn, and the second rotating arms 9 and the fourth rotating arms 11 are connected in turn, forming the surface layers of two curtain faces of the front and back sides of the whole telescoping curtain 1. The frameworks 6 of a plurality of continuously arrayed telescoping units 5 play a support and connection role and form an inner hollow structure. Each one of the partitions 13 divides the inner space of each corresponding one of the telescoping units 5 into two layers, namely an inner layer and an outer layer, or further divides the inner space into multiple layers, thus enhancing the heat insulation effect.

The telescoping curtain 1 is respectively provided with a connecting structure 12 which is combined with the window and combined with an installed housing casing at each one of the two ends, reducing other auxiliary devices of the telescoping curtain 1.

The telescoping curtain 1 is molded mainly by an extrusion process. The surface of the telescoping curtain 1 may be sprayed or coated with other heat-insulating and fire-retardant coatings or materials.

The hollow space is filled with air, or the hollow cavity may be added with other porous or foam materials with a reactively smaller density by means of filling and foaming, for example, Pu foam, cotton, etc., to achieve a better heat insulation effect.

The telescoping curtain for a window-type air conditioner provided by the utility model mainly adopts a foldable structure which is hollow inside and has a wrinkled appearance, capable of being made by a blow molding process or an extrusion (extrusion molding) process. The inner hollow space may be completely filled in with air, or added with other porous and foam materials to achieve a better heat insulation effect. The telescoping curtain 1 may merely achieve the folding and heat insulation effects, and other components can be designed to meet the requirements of installing frames and assembling the whole machine.

The telescoping curtain for the window-type air conditioner provided by the utility model solves the problems of use of foam 3 to achieve the heat insulation effect, complicated operation, and difficulties in actual operation in the prior art. The utility model adopts a foldable hollow grid structure to achieve the heat insulation effect and folding effect, namely using a single telescoping and foldable component to conduct the telescoping function of the telescoping curtain 1 and the heat insulation function of the foam of the existing old-fashioned telescoping curtain. The space partitioning carried out by the telescoping curtain 1 and the heat insulation performed by the foam 3 are integrated. An integrated structure achieves the effects of heat insulation and space partitioning between the indoor and outdoor environment, overcoming the inconvenience in sticking and assembly for users, and effectively ensuring the heat insulation effect.

The contents of the utility model are described in detail through the above preferable embodiments, but it should be recognized that the above description shall not be regarded as a limit to the utility model. After those skilled in the art read the above content, various modifications and replacements made on the utility model by those skilled in the art are obvious. Therefore, the protective scope of the utility model shall be defined by the attached Claims.

What is claimed is:

1. A telescoping curtain for a window-type air conditioner, characterized in that the telescoping curtain is comprised of a plurality of telescoping units which are continuously arrayed; the telescoping units are hollow and elongated shaped columns; a framework is disposed on each one of the two sides of each one of the telescoping units, and four rotating arms are disposed between two adjacent frameworks; wherein the frameworks are rectangular sheets disposed in a longitudinal way, all frameworks in the telescoping curtain are parallel to one another and respectively vertical to the plane where the telescoping curtain exists, and form two elongated rectangular edges; each one of the frameworks is respectively provided with a first rotating arm and a second rotating arm located on one side face of the framework, and a third rotating arm and a fourth rotating arm located on the other side of the framework; wherein the first rotating arm on each one of the frameworks is connected with the third rotating arm on the adjacent framework, while the second rotating arm is connected with the fourth rotating arm on the adjacent next framework, the four rotating arms and the frameworks on two sides form one of the telescoping units; wherein each one of the rotating arms is capable of rotating around their respective side faces of the connected framework sheet, and two adjacent rotating arms are also capable of performing relative rotation.

2. The telescoping curtain for a window-type air conditioner according to claim 1, characterized in that partitions are uniformly disposed in the hollow inner space of each one of the telescoping units to divide each one of the telescoping units into a plurality of layers; and the telescoping units are consistent in the number and positions of the partitions therein.

3. The telescoping curtain for a window-type air conditioner according to claim 2, characterized in that each one of the partitions is comprised of two partition rotating arms which are connected on the inner sides thereof, while the outer sides of the two partition rotating arms are respectively connected with the framework on the same side of each one of the corresponding telescoping units; and the two connected partition rotating arms are capable of performing relative rotation.

4. The telescoping curtain for a window-type air conditioner according to claim 1, characterized in that each one of the four rotating arms is a rectangular sheet disposed in a longitudinal way, with the rectangular edge on one side of the corresponding framework sheet connected with the rectangular edge of the other corresponding framework sheet.

5. The telescoping curtain for a window-type air conditioner according to claim 4, characterized in that among the four rotating arms, the first rotating arm and the third rotating arm on one framework are connected with the same long edge of the framework sheet and unfold toward the two sides of the framework sheet, and the second rotating arm and the fourth rotating arm are connected with the other long edge of the framework sheet and unfold toward the two sides of the framework sheet.

6. The telescoping curtain for a window-type air conditioner according to claim 5, characterized in that among the four rotating arms, the distance between the proximal and distal edges of each one of the four rotating arm sheets is ½ of the distance between the two rectangular edges of each one of the frameworks; and the distance between the two rectangular edges of each one of the framework sheets is 10-30 mm.

7. The telescoping curtain for a window-type air conditioner according to claim 6, characterized in that the frameworks and the rotating arms are molded by integrated extrusion, and the surfaces of the frameworks and rotating arms are sprayed or covered with a heat-insulating fire-retardant sunscreen layer.

8. The telescoping curtain for a window-type air conditioner according to claim 7, characterized in that the framework at the outermost side of each one of the two ends of the telescoping curtain is provided with two inward rotating arms; and on the outside face of each one of the two ends of the telescoping curtain, the two respective frameworks are provided with a connecting structure for installing and fixing the telescoping curtain.

9. The telescoping curtain for a window-type air conditioner according to claim 8, characterized in that the telescoping curtain has a telescoping distance within a range of 50-350 mm from the point where all the telescoping units are completely compressed to the point where all the telescoping units are completely unfolded.

10. The telescoping curtain for a window-type air conditioner according to claim 9, characterized in that fillers in the hollow space in the telescoping units are air or porous foam fillers.

* * * * *